US010876794B2

(12) United States Patent
Bergh

(10) Patent No.: US 10,876,794 B2
(45) Date of Patent: Dec. 29, 2020

(54) GASKETED PLATE AND SHELL HEAT EXCHANGER

(71) Applicant: Ingersoll-Rand Company, Davidson, NC (US)

(72) Inventor: Charles John Bergh, Berwyn, PA (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 210 days.

(21) Appl. No.: 15/620,459

(22) Filed: Jun. 12, 2017

(65) Prior Publication Data

US 2018/0356159 A1 Dec. 13, 2018

(51) Int. Cl.

| | |
|---|---|
| ***F28D 9/00*** | (2006.01) |
| ***F28F 3/08*** | (2006.01) |
| ***F28F 3/10*** | (2006.01) |
| ***F28G 13/00*** | (2006.01) |

(52) U.S. Cl.

CPC ..... *F28D 9/0006* (2013.01); *F28D 9/005* (2013.01); *F28D 9/0025* (2013.01); *F28F 3/083* (2013.01); *F28F 3/10* (2013.01); *F28G 13/00* (2013.01); *F28F 2230/00* (2013.01); *F28F 2275/06* (2013.01); *F28F 2280/02* (2013.01)

(58) Field of Classification Search

CPC ..... F28D 9/0006; F28D 9/005; F28D 9/0025; F28G 13/00; F28F 3/10; F28F 3/083; F28F 2275/06; F28F 2280/02; F28F 2230/00

See application file for complete search history.

(56) References Cited

U.S. PATENT DOCUMENTS

| | | | | |
|---|---|---|---|---|
| 2,877,000 A * | 3/1959 | Person | F28D 1/0316 165/159 |
| 3,727,681 A * | 4/1973 | Fernandes | F28F 9/00 165/158 |
| 3,796,547 A | 3/1974 | Muenger | |
| 3,831,674 A * | 8/1974 | Stein | F28D 9/0012 165/166 |
| 3,894,581 A * | 7/1975 | Jacobsen | F28D 9/00 165/166 |
| 3,931,854 A * | 1/1976 | Ivakhnenko | F28D 9/0037 165/166 |

(Continued)

FOREIGN PATENT DOCUMENTS

| | | |
|---|---|---|
| EP | 0 614 061 A1 * | 9/1994 |
| EP | 3 023 727 A1 * | 5/2016 |

(Continued)

OTHER PUBLICATIONS

European Search Report, European Patent Application No. 18176360.8, dated Jun. 11, 2016, 7 pages.

*Primary Examiner* — Ljiljana V. Ciric

(74) *Attorney, Agent, or Firm* — Taft Stettinius & Hollister LLP

(57) ABSTRACT

A heat exchanger includes a heat exchanger shell and a heat exchanger core defined by plurality of core elements releasably connected together when positioned within the heat exchanger shell. Each core element is defined by first and second opposing plates permanently fixed together with a fluid flow path formed therebetween. A coolant flow path is formed between adjacent core elements. A fluid seal positioned between adjacent core elements is configured to form a fluid tight seal between the fluid flow path and the coolant flow path.

13 Claims, 5 Drawing Sheets

(56) References Cited

U.S. PATENT DOCUMENTS 4,073,340 A * 2/1978 Parker ..... F28D 9/00 165/166
4,291,752 A * 9/1981 Bridgnell ..... F28F 9/005 165/81
4,314,607 A * 2/1982 DesChamps ..... F28D 9/0025 165/166
4,343,355 A * 8/1982 Goloff ..... F28D 9/0025 165/166
4,384,611 A * 5/1983 Fung ..... F28D 9/0025 165/166
4,911,235 A * 3/1990 Andersson ..... F28F 3/083 165/166
5,193,612 A * 3/1993 Stirnkorb ..... F28F 3/10 165/167
5,228,515 A * 7/1993 Tran ..... F28D 9/0037 165/166
5,303,771 A * 4/1994 Des Champs ..... F28D 9/0025 165/165
5,368,095 A * 11/1994 Kadambi ..... F28D 9/0018 165/83
5,465,785 A * 11/1995 Adderley ..... F28D 9/0006 165/166
5,486,010 A * 1/1996 Hamilton ..... B29C 55/005 277/312
5,522,462 A * 6/1996 Kumar ..... F28D 9/005 165/166
5,636,527 A * 6/1997 Christensen ..... B01J 10/00 165/170
5,727,620 A * 3/1998 Schaufele ..... F28F 3/10 165/166
5,775,412 A * 7/1998 Montestruc, III .... F28D 9/0037 165/134.1
6,016,865 A 1/2000 Blomgren
6,098,701 A 8/2000 Blomgren
6,155,338 A * 12/2000 Endou ..... F28D 9/0025 165/165
6,192,975 B1 * 2/2001 Yanai ..... F28D 9/0025 165/146
6,241,011 B1 * 6/2001 Nakamura ..... F28D 1/0341 165/153
6,241,875 B1 * 6/2001 Gough ..... B01J 8/0285 165/134.1
6,289,977 B1 * 9/2001 Claudel ..... B23K 26/10 165/157
6,378,603 B1 * 4/2002 Shimoya ..... F28D 1/0333 165/148
6,460,614 B1 * 10/2002 Hamert ..... B01J 19/0013 165/170
6,470,963 B2 * 10/2002 Carpentier ..... F28D 9/0006 165/159
6,478,081 B1 * 11/2002 Shaw ..... F28D 9/005 165/167
7,004,237 B2 2/2006 Mathur et al.
7,044,207 B1 * 5/2006 Guidat ..... F28F 3/14 165/170
7,121,330 B2 * 10/2006 Matsuzaki ..... F28D 9/0037 165/165
7,490,660 B2 * 2/2009 Song ..... F28F 3/10 165/166
7,857,036 B2 12/2010 Bergqvist et al.
8,453,721 B2 6/2013 Mathur et al.
8,596,339 B2 * 12/2013 Palanchon ..... F02M 26/32 165/103
9,724,746 B2 * 8/2017 Eleftheriou ..... F28F 3/046
9,879,919 B2 * 1/2018 Hisanaga ..... F28D 7/1684
10,087,813 B2 * 10/2018 Okami ..... F28D 9/0043
10,197,346 B2 * 2/2019 Kesala ..... F28F 3/046
10,337,800 B2 * 7/2019 Taylor ..... F28D 9/0006
10,396,415 B2 * 8/2019 Foerster ..... H01M 10/613
10,527,361 B2 * 1/2020 Persson ..... F28F 3/10
10,571,204 B2 * 2/2020 Arndt ..... F28F 21/067
10,591,220 B2 * 3/2020 Bluetling ..... F28D 9/005
10,619,946 B2 * 4/2020 Meshenky ..... F28D 9/005
10,634,433 B2 * 4/2020 Andersen ..... F28D 9/0043
10,724,806 B2 * 7/2020 Seo ..... F28F 3/10
10,753,686 B2 * 8/2020 Kim ..... F25B 39/04
2006/0219394 A1 * 10/2006 Martin ..... F28F 3/025 165/157
2007/0044947 A1 * 3/2007 Franz ..... F28D 9/0031 165/166
2008/0179049 A1 7/2008 Mathur et al.
2008/0196873 A1 8/2008 Svensson
2009/0008072 A1 * 1/2009 Rassmus ..... F28D 9/005 165/167
2009/0008074 A1 * 1/2009 Vamvakitis ..... F28D 7/0083 165/177
2009/0090496 A1 * 4/2009 Blomgren ..... F28D 9/0012 165/166
2009/0159251 A1 6/2009 Blomgren
2009/0194267 A1 8/2009 Gustafsson
2010/0096101 A1 * 4/2010 Braun ..... F02B 29/0462 165/41
2010/0276128 A1 11/2010 Taylor
2012/0103578 A1 * 5/2012 Taylor ..... F28D 9/0031 165/157
2012/0285423 A1 * 11/2012 Nguyen ..... F28F 9/002 123/542
2013/0306283 A1 * 11/2013 Bader ..... F28D 9/005 165/166
2014/0000842 A1 * 1/2014 Gruneisen ..... F28F 9/001 165/76
2014/0326432 A1 * 11/2014 Dean ..... F28D 9/0025 165/54
2015/0129181 A1 * 5/2015 John ..... B23P 15/26 165/157
2016/0123676 A1 * 5/2016 Lee ..... F28D 9/005 165/166
2016/0204486 A1 * 7/2016 Kenney ..... F28F 1/045 429/120
2016/0273845 A1 * 9/2016 Rizzi ..... F28F 9/013
2016/0313073 A1 * 10/2016 Larsson ..... F28F 9/002
2016/0341490 A1 * 11/2016 Schmid ..... F28F 9/26
2017/0038168 A1 * 2/2017 Arndt ..... F28D 9/0043
2017/0106639 A1 * 4/2017 Vandermeulen ..... B29C 65/02
2018/0356159 A1 * 12/2018 Bergh ..... F28D 9/005
2020/0093089 A1 * 3/2020 Xu ..... A01K 1/0076
2020/0116440 A1 * 4/2020 Andersen ..... F28D 9/005

FOREIGN PATENT DOCUMENTS

EP 3112787 A 1/2017
WO 2007114777 A 10/2007
WO 2010039086 A 4/2010
WO 2012159882 A1 11/2012
WO 2013106240 A 7/2013

* cited by examiner

GASKETED PLATE AND SHELL HEAT EXCHANGER

TECHNICAL FIELD

The present application generally relates to heat exchangers and more particularly, but not exclusively, to heat exchangers with a gasketed plate and shell construction.

BACKGROUND

Heat exchangers are configured to exchange heat between at least two mediums. Coolant in the form of a gas or liquid can be used to remove heat from the heat exchanger. In some forms, the coolant used to cool a heated fluid can have material deposits precipitated therefrom. Over time, the deposits and can build up on internal wall surfaces of the heat exchanger, and reduce the efficiency thereof. In such cases, periodic cleaning may be required. Some existing systems have various shortcomings relative to certain applications. Accordingly, there remains a need for further contributions in this area of technology.

SUMMARY

One embodiment of the present disclosure is a heat exchanger with plate elements constructed to be releasably connected together to provide access for periodic removal of material deposits on internal surfaces thereof. Other embodiments include apparatuses, systems, devices, hardware, methods, and combinations for heat exchangers with a unique construction of heat exchanger elements. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
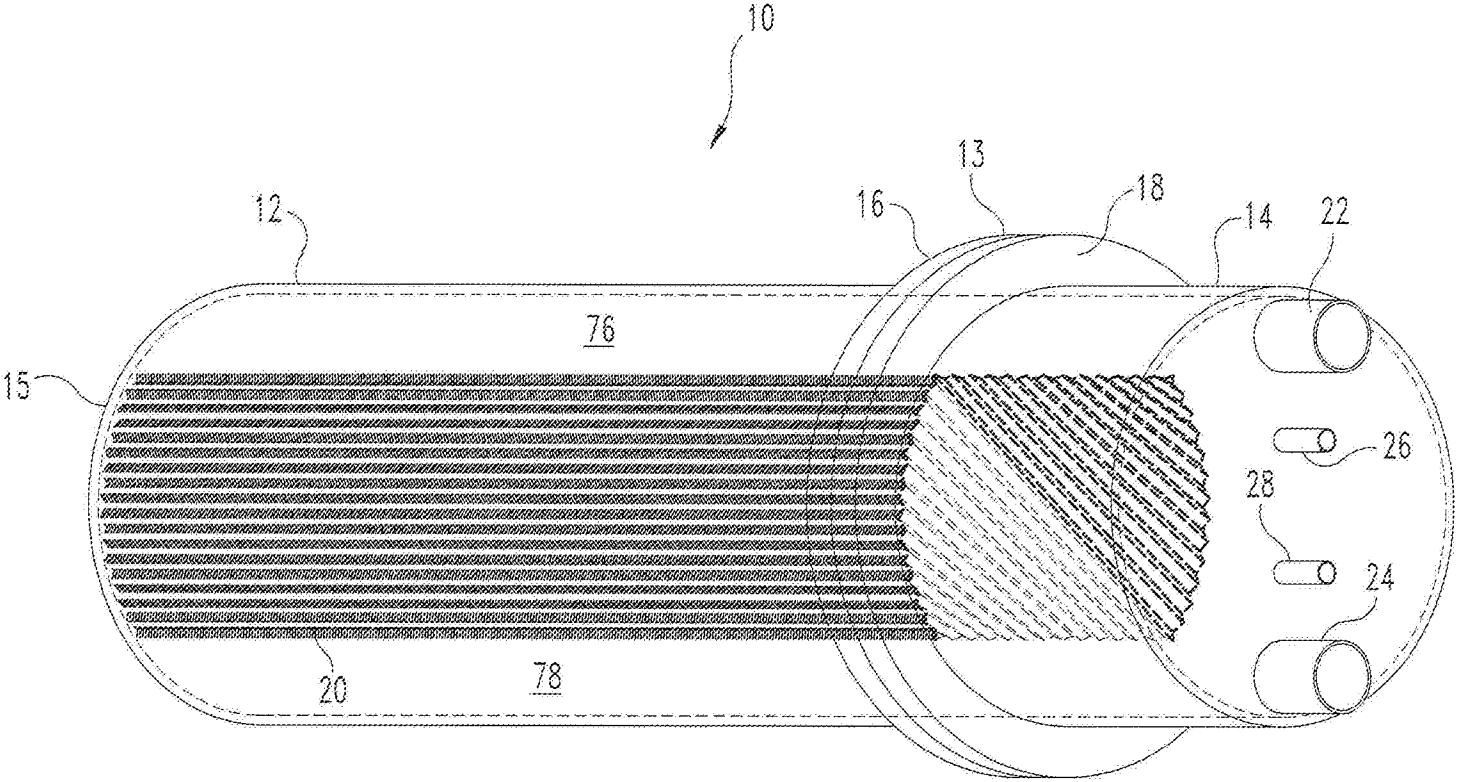
FIG. 1 is a perspective view of an exemplary heat exchanger according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Some systems use heat exchangers to control the temperature of fluids at various stages within the system. An exemplary system operable with the heat exchanger system described herein can include industrial compressor systems that are configured to provide compressed fluids at a desired temperature, pressure and mass flow rate. The term "fluid" as used herein, should be understood to include any gas or liquid medium that may be used in a heat exchanger system defined in the present disclosure. When the term "heated air" or "gas" is used it should be understood that other working fluids can be substituted and not depart from the teachings of the present disclosure.

Referring now to FIG. 1, an exemplary heat exchanger 10 is illustrated in a perspective view with internal portions visible therein. The heat exchanger 10 can include a housing shell 12 with a removable head 14 connectable to one end thereof. In one form the shell 12 can include a cylindrical shape extending from a first end 13 to a second end 15. In other forms the shell 12 can include non-cylindrical shapes as one skilled in the art would understand. The head 14 and shell 12 can be connected via mechanical fastening through a pair of mating flanges 16, 18 extending from the shell 12 and the head 14, respectively, proximate the first end 13 of the shell 12. In alternate embodiments other means for connecting the head 14 to the shell 12 can be employed as desired.

The heat exchanger 10 includes a heat exchanger core 20 positioned within the shell 12. A fluid inlet port 22 extends from the head 14 to provide ingress of a heated fluid such as compressed air discharged from a compressor (not shown) to the heat exchanger core 20. The heated fluid can enter the inlet port 22, flow through the heat exchanger core 20 and egress through a fluid outlet port 24 extending from the head 14. A coolant inlet port 26 extends from the head 14 to permit coolant, such as for example water or a water based mixture, to enter into the heat exchanger core 20 and to cool the heated fluid as the heated fluid and coolant flows through the heat exchanger core 20. It should be noted that any coolant known to the skilled artisan may be used and is contemplated by the present disclosure. The coolant exits the heat exchanger 10 through the coolant outlet port 28 extending from the head 14. By operation of heat transfer principles, the coolant will increase in temperature and the heated fluid will decrease in temperature as they flow through the exchanger core 20 and exchange heat between one another. It should be noted that the location of various features such as the inlet and outlet ports 22, 24 for both the heated fluid and the coolant as shown in the exemplary embodiment need not be located or formed as shown in FIG. 1, but may be located in other positions and remain within the teachings of the present disclosure.

Figure 2:
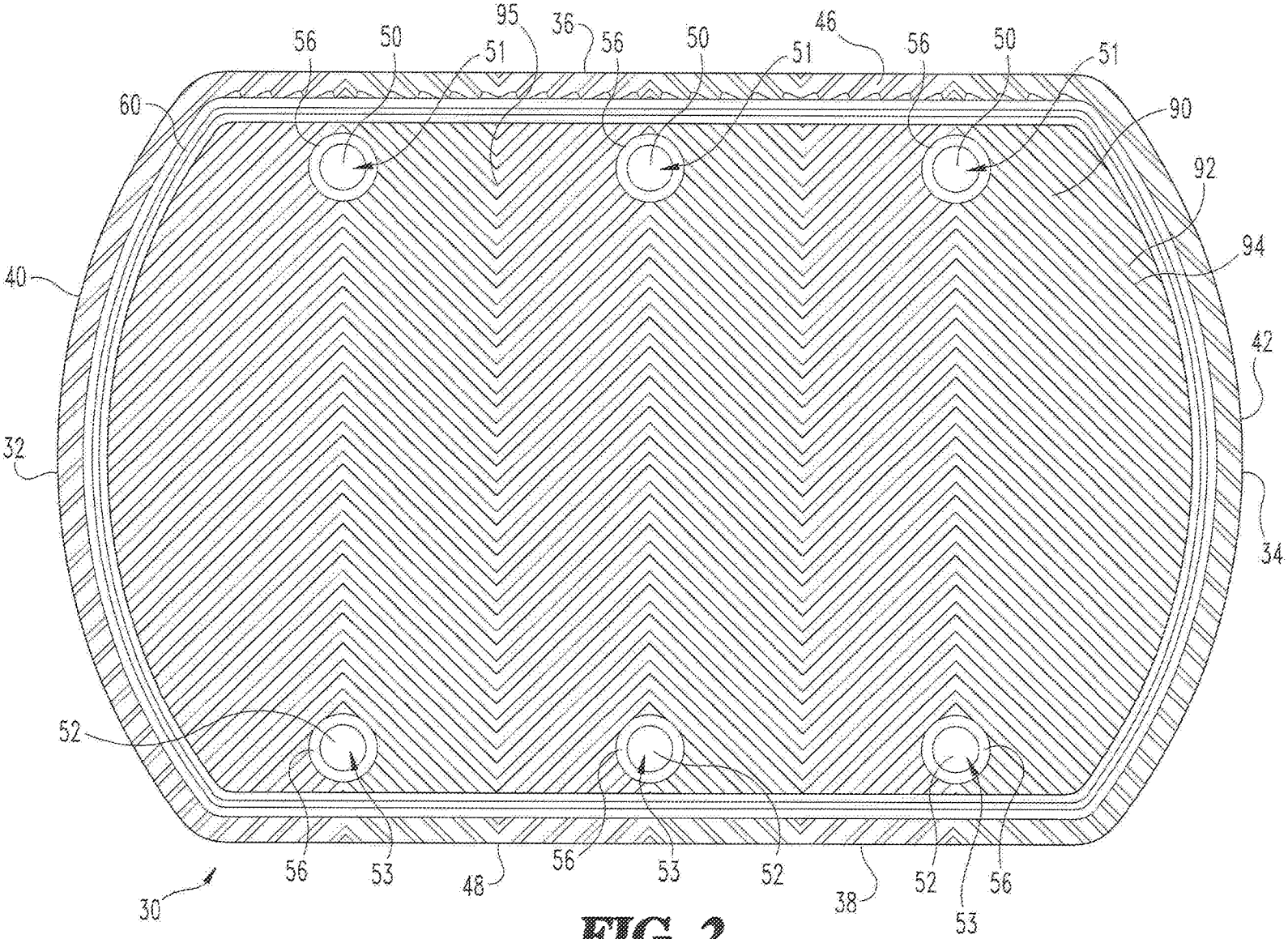
FIG. 2 is a front view of a core heat exchanger element according to one embodiment of the present disclosure.

Referring now to FIG. 2, a front view of a core element 30 according to one embodiment of the disclosure is illustrated therein. The heat exchanger core 20 (see FIG. 4) is constructed with a plurality of core elements 30 stacked adjacent one another in a sealed arrangement. Although not shown in FIG. 2, each core element 30 includes two substantially similar plates 82, 84 (see FIG. 4) spaced apart from one another in certain regions thereof and permanently attached together via weld or other mechanical fastening means in other regions. The core element 30 includes a width that extends from a first end wall 32 to an opposing second end wall 34. In one form, the shape of the first and second end walls 32, 34 can be of a similar shape to that of the shell housing 12 (see FIG. 1). In the illustrated embodiment the shape is circular to match the circular cross section of the cylindrical shell 12. As discussed previously, other shapes can be constructed in alternate embodiments and remain within the teachings herein.

The core element 30 includes a top end wall 36 and an opposing bottom end wall 38 that are spaced apart from the shell 12 to form open regions or plenums 76 and 78 (See FIGS. 1 and 3) that will be further explained below. The top end wall 36 and bottom end wall 38 is illustrated as being substantially flat or planer, however this is not required to practice the teachings herein. It should be noted that the terms such as "side end wall", "top end wall" and "bottom end wall" are non-limiting and are only intended to describe relative position references and not absolute locations in a fixed reference frame.

The first and second side end walls 32, 34 can include peripheral seals 40, 42, respectively connected thereto. The peripheral seals 40, 42 can be constructed to engage with the shell 12 to prevent fluid from bypassing the heat exchanger core 20 (see FIG. 1) through an unsealed gap between the heat exchanger core 20 and the shell 12. The core element 30 includes a fluid entrance channel 46 proximate the top end wall 36 and a fluid exit channel 48 proximate the bottom end wall 38 thereof. While the exemplary embodiment illustrates inlet flow through the "top" and outlet flow through the "bottom" of the heat exchanger core, it should be understood that this description is non-limiting and that the fluid flow can enter and move through the heat exchanger core 20 in any desired location and direction.

Each core element 30 can include one or more coolant inlet pathways 51 in fluid communication with the coolant inlet port 26 of the head 14. Each coolant inlet pathway 51 is formed though the heat exchanger core 20 when a plurality of heat exchanger elements 30 are assembled together and a plurality coolant inlet apertures 50 in each of the core elements 30 are in fluid communication with one another. After the coolant flows through the heat exchanger core 20, the coolant exits through one or more outlet pathways 53 formed in the heat exchanger core 20. The one or more outlet pathways 53 are formed by placing coolant outlet apertures 52 formed in each heat exchanger element 30 in fluid communication with one another when a plurality of heat exchanger elements 30 are assembled together. Each of the coolant inlet apertures 50 and coolant outlet apertures 52 can include a seal 56 to form a fluid tight connection around the apertures and prevent mixing of the coolant and the heated fluid within the heat exchanger core 20. In one form the seal 56 is defined by a welded joint around the apertures 50, 52. In other forms the seal 56 can include braze, epoxy, or other types of mechanical seals as known by those skilled in the art. The seal 56 can also serve to permanently connect the first and second plates 82, 84 together when forming each heat exchanger element 30 in some embodiments. Further, each core element 30 can include a perimeter seal 60 such as a gasket or O-ring or the like. Material composition for the seal 60 can be any type that can seal heated liquids and gases without degradation over an expected life span of the heat exchanger core 20. The seal 60 is engaged between adjacently positioned core elements 30 when the core elements 30 are assembled in the heat exchanger core 20. The seal 60 is operable to prevent the heated fluid and coolant from mixing within the heat exchanger core 20. Each core elements 30 include a corrugated wall 90 on either side of each plate 82, 84 (See FIGS. 4 and 5). The corrugated wall 90 includes a plurality of alternating peaks 92 and troughs 94. The corrugated wall 90 can include alternating V-shaped patterns and/or inverse V-shaped patterns 95. However it should be understood that other patterns of varying angles, shapes, and orientations are contemplated herein.

Figure 3:
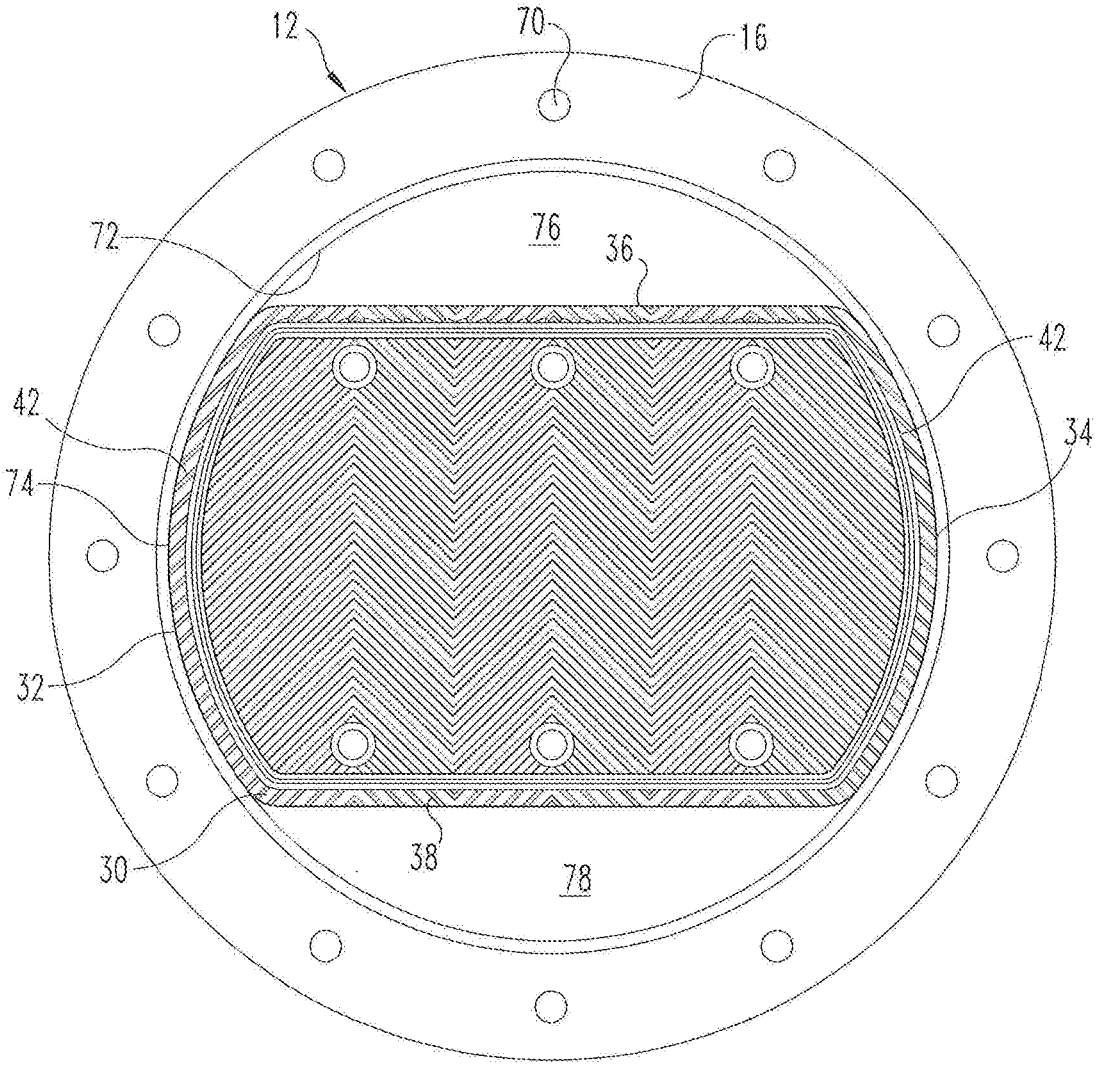
FIG. 3 is a front view of a heat exchanger with a core element positioned in a shell thereof.

Referring now to FIG. 3, a front view of the core element 30 is shown positioned within the shell 12 of the heat exchanger 10 with the head 14 removed to provide clarity. The flange 16 of the shell 12 can include a plurality of fastening apertures 70 to provide attachment means with the mating flange 18 of the head 14 (see FIG. 1). The shell 12 includes an inner wall 72 that is defined by a circular cross-section cylindrical shell 12 in the illustrative embodiment of the present disclosure. In other forms, other cross-sectional shapes can include non-circular arcuate portions and/or linear segments and the like. A seal interface 74 is defined between the first and second end walls 32, 34 of the core element 30 and a portion of the inner wall 72 of the heat exchanger shell 12. The heated fluid enters through the fluid inlet port 22 (see FIG. 1) and enters into the inlet plenum 76 between the top end wall 36 of the heat exchanger core 20 and inner wall 72 of the shell 12. The heated fluid then flows through the heat exchanger core 20 and discharges into the outlet plenum 78 between the bottom end wall 38 of the heat exchanger core 20 and the inner wall 72 of the heat exchanger shell 12. After the heated fluid is cooled in the heat exchanger core 20, the cooled fluid exits from the outlet plenum 78 through the outlet port 24 of the head 14 (see FIG. 1).

Figure 4:
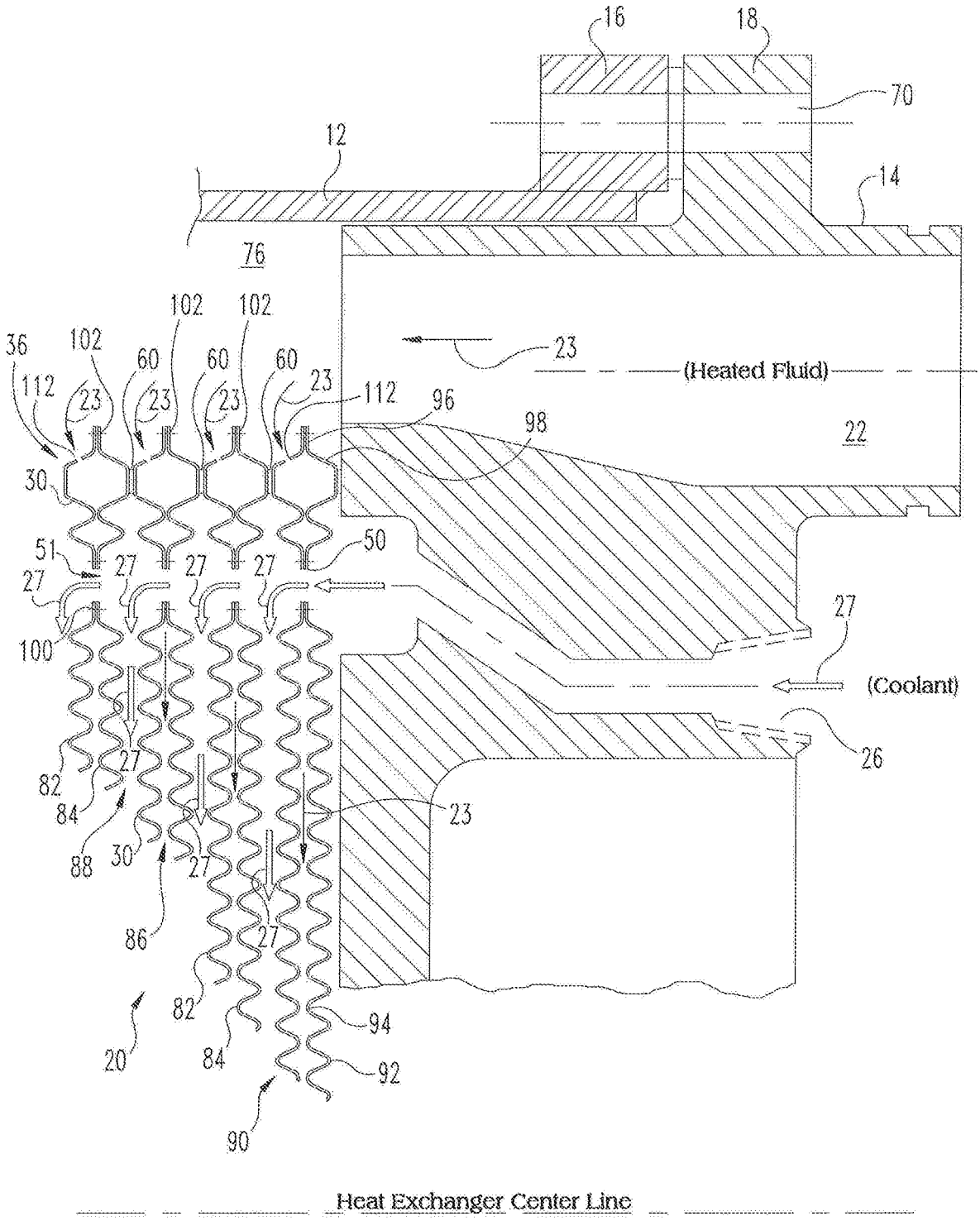
FIG. 4 is a cross-sectional view of a portion of the heat exchanger of FIG. 1.
Figure 5:
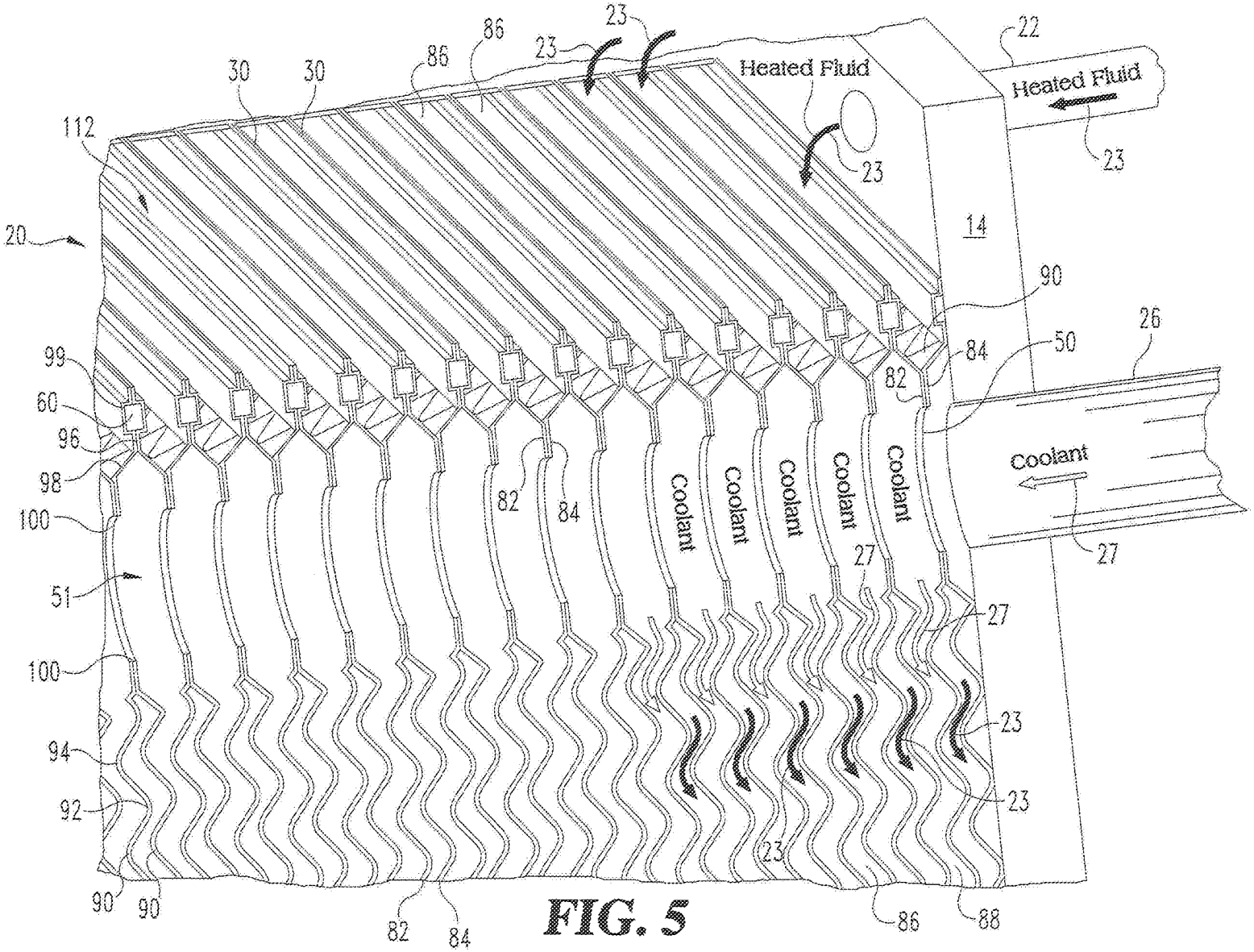
FIG. 5 is a partial perspective cut-away view of a portion of the heat exchanger of FIG. 1.

Referring now to FIGS. 4 and 5, a cross-sectional view and a partial perspective cut-away view of a portion of the head 14, the shell 12, and the heat exchanger core 20 are illustrated, respectively. The heated fluid represented by arrow(s) 23 is transported through the inlet port 22 and into the inlet plenum 76 of the shell 12 and is then directed through each of the plurality of core elements 30 that are assembled adjacent to one another to form the heat exchanger core 20. Each core element 30 includes a first plate 82 and a second plate 84 that are fixedly attached to one another so as to define an inseparable assembly. The plates 82, 84 are made from a conductive material such as aluminum or the like, to enhance heat transfer between the coolant flow paths and the heated fluid flow paths. In one form, the plates 82, 84 can be welded in a plurality of predetermined locations. In other forms the plates 82, 84 may be manufactured as a single unitary structure through manufacturing processes such as a casting process or a billet machining process and the like. A fluid flow path 86 is formed between the first and second plates 82, 84 in each core element 30. Coolant flow paths 88 are formed between a plate (82 or 84) of one core element 30 and a plate (82 or 84) of an adjacent core element 30 along the heat exchanger core 20. The coolant flow paths 88 are constructed between adjacent core elements 30 so as to provide access to the boundary walls of the coolant flow paths 88 when the heat exchanger core 20 is disassembled. In this manner the external walls of each plate 82, 84 can be cleaned, scrubbed or otherwise maintained to remove material deposits that have precipitated from the coolant and accumulated over time.

Each of the plates 82, 84 can include corrugated walls 90 defined by alternating peaks 92 and troughs 94 to provide a tortuous flow path for the coolant and the heated fluid to flow through. As described previously and seen more clearly in FIG. 2, the corrugated wall 90 can include alternating V-shaped patterns 95 (see FIG. 1) and/or inversed V-shaped patterns alternating across the heat exchanger element 30 from one side wall 32 to the opposing side wall 34 in one form of the present disclosure. The corrugated walls 90 facilitate heat transfer between the fluid and the coolant by promoting turbulent flow to increase heat transfer coefficients as would be understood by the skilled artisan. In some forms, the plates 82, 84 can include a vertical stem 96 extending to an angled leg 98 proximate the top and bottom (not shown) of the heat exchanger core 20. A seal housing 99 can be formed between adjacent vertical stems 96 as shown in FIG. 5. The seal housing 99 can be a rectangular shape as shown or other shapes depending on the type of seal 60 utilized therein. The seal housing 99 is configured to sealingly engage with a gasket 60 to prevent the coolant from leaking out of the coolant path ways 88.

The coolant inlet apertures 50 of the heat exchanger element 30 define a coolant inlet pathway 51 through the core 20 that permits coolant, represented by arrows 27, to flow from the coolant inlet port 26 and into the plurality of coolant flow paths 88 formed between adjacent core elements 30. The coolant outlet apertures 52 (not shown in FIG. 4 or 5) define a coolant outlet pathway 53 in heat exchanger core 20 that receives coolant from the coolant flow paths 88 and directs the coolant out of the heat exchanger 10 through the coolant outlet port 24 (see FIG. 1).

The plates 82, 84 of each core element 30 can be connected together via weld joints 100 around the coolant inlet and outlet apertures 50, 52, respectively. The weld joints 100 can operate as both a seal between the coolant and heated fluid flow paths and a mechanical connection to couple the plates 82, 84 together. Further, additional weld joints 102 (FIG. 4) for connecting additional portions of the plates 82, 84 together can be formed proximate the top end wall 36 and/or bottom end wall 38 (not shown) of the heat exchanger element 30. The weld joints 102 may be formed substantially about an entire perimeter of the heat exchanger element 30 or alternatively at intermittent locations around the perimeter.

The heated fluid, represented by arrows 23, enters into each fluid flow path 86 in the heat exchanger core 20 though openings 112 formed in one or more locations in each heat exchanger element 30. The openings 112 are fluidly isolated from the coolant flow by means of perimeter seals 60 positioned between adjacent heat exchanger elements 30. The perimeter seals or gaskets 60 are positioned radially outward of the coolant inlet and outlet apertures 50, 52 respectively and operate to prevent mixing of the coolant and the heated fluid. In some embodiments, openings 112 as illustrated may be omitted and the heated fluid may enter into the fluid flow path 86 between the plates 82, 84 between circumferential locations of the interment weld joints 102. In other embodiments, defined as those without weld joints 102, heated fluid may enter into the fluid flow path 86 between the plates 82, 84 anywhere along a circumferential perimeter.

In one aspect, the present disclosure includes a heat exchanger comprising: a heat exchanger shell; a heat exchanger core defined by plurality of core elements releasably connected together and positioned within the heat exchanger shell, wherein each core element is defined by first and second opposing plates permanently fixed together; a fluid flow path formed between the first and second plates; a coolant flow path formed between opposing plates of adjacent core elements; and a fluid seal positioned between adjacent core elements, the seal configured to form a fluid tight boundary between the fluid flow path and the coolant flow path.

In refining aspects, the present disclosure includes a head having a fluid inlet port, a fluid outlet port, a coolant inlet port and a coolant outlet port connectable to the heat exchanger shell; an inlet plenum located between the heat exchanger shell and the heat exchanger core and an outlet plenum located between the heat exchanger shell and the heat exchanger core separate from the inlet plenum; wherein each core element includes a coolant inlet aperture and a coolant outlet aperture formed through the first and second plates respectively; wherein the coolant flow path extends between the coolant inlet apertures and the coolant outlet apertures within the core; further comprising a fluid tight seal formed about the coolant inlet and the coolant outlet apertures to prevent fluid communication between the fluid flow path and the coolant flow path; wherein the heat exchanger shell includes an inner wall formed with arcuate sections; wherein the heat exchanger core includes arcuate first and second sidewall portions substantially conforming with the arcuate sections of the inner wall of the heat exchanger shell; a peripheral seal engaged between the arcuate sidewall portions and the arcuate sections of the inner wall of the shell; wherein each of the opposing plates of each core element includes a corrugation construction with alternating peaks and troughs; wherein the peaks and troughs of the corrugation construction include an alternating angled V-shaped pattern formed across each plate of each core element; wherein the V-shaped pattern on the first plate of each core element is an opposite mirror image of the V-shaped pattern on the second plate of each core element; and wherein the peaks of the corrugation pattern on adjacent plates engage one another at intermittent locations across the plates.

In another aspect, the present disclosure includes an apparatus operable for heating a fluid; a heat exchanger operable for cooling the fluid with a coolant, the heat exchanger comprising: a heat exchanger element defined by a first plate and a second plate permanently coupled to one another; a heat exchanger core defined by a plurality of heat exchanger elements positioned adjacent one another within a heat exchanger shell; a fluid flow path defined between the first and second plates of each heat exchanger element; a coolant flow path defined between adjacent heat exchanger elements; and a peripheral seal positioned between adjacent heat exchanger elements operable to prevent mixture of the coolant and the fluid within the heat exchanger.

In refining aspects, the present disclosure further comprises a coolant inlet aperture formed through each plate of each heat exchanger element, such that a core coolant inlet pathway is formed through the plurality of heat exchanger elements; a coolant outlet aperture formed through each plate of each heat exchanger element, such that a core coolant outlet pathway is formed through the plurality of heat exchanger elements; an aperture seal positioned around a perimeter of each the inlet apertures and the outlet apertures to prevent mixing of the coolant and the fluid proximate the inlet and outlet apertures; wherein the aperture seal includes a welded joint formed between the first and second plates of each of the heat exchanger elements; wherein the heat exchanger core includes: a top end wall spaced apart from an inner wall of the heat exchanger shell; a bottom end wall spaced apart from the inner wall of the heat exchanger shell; a fluid inlet plenum formed in a first space defined between the top end wall of the heat exchanger core and the inner wall of the heat exchanger shell, the inlet plenum configured to receive heated fluid from the apparatus; and a fluid outlet plenum formed in a second space defined between the bottom end wall of the heat exchanger core and the inner wall of the heat exchanger shell, the outlet plenum configured to receive cooled fluid from the heat exchanger core; wherein each of the first and second plates of each core element includes a corrugation construction with alternating peaks and troughs; wherein the peaks and troughs of the corrugation construction includes a plurality of alternating V-shaped patterns formed across each plate; and wherein at least one corrugation peak on one plate engages a corrugation peak of an adjacent plate.

In another aspect, the present disclosure includes a method comprising positioning a plurality of heat exchanger elements adjacent to one another into a heat exchanger shell to form a heat exchanger core, wherein each heat exchanger element includes first and second plates permanently fixed to one another with a fluid flow path formed therebetween and the heat exchanger elements are removeably connected to one another in a sealed arrangement; flowing a heated fluid through a head and into an inlet plenum formed in a first space between the heat exchanger core and the heat exchanger shell; flowing a coolant through the head and into a coolant inlet pathway formed through a plurality of heat exchanger elements positioned adjacent to one another in the heat exchanger shell; directing the fluid into a fluid flow path formed between the first and second plates of each heat exchanger element; transferring heat from the fluid in the fluid flow path to coolant flowing in an adjacent coolant flow path; preventing mixing of the coolant and the fluid with a peripheral seal positioned between adjacent heat exchanger elements; flowing cooled fluid from the heat exchange core into an outlet plenum formed between a second space between the heat exchanger core and the heat exchanger shell; discharging the cooled fluid from the outlet plenum through a fluid outlet port in the head; and discharging the coolant from the heat exchanger shell through a fluid outlet port in the head.

In refining aspects the present disclosure includes a method of removing individual heat exchanger elements from the heat exchanger core, and removing material deposits from external surfaces of the first and second plates; and reinstalling the cleaned heat exchanger elements into the heat exchanger core.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A heat exchanger comprising: a heat exchanger shell; a heat exchanger core defined by a plurality of core elements releasably connected together and positioned within the heat exchanger shell, wherein each core element consists essentially of a first plate and a second opposing plate permanently fixed together, a fluid flow path formed between the first plate and the second opposing plate; a coolant flow path formed between two directly adjacent core elements; a seal housing; and, a fluid seal disposed in the seal housing, the fluid seal positioned between the two directly adjacent core elements and in contact with the two directly adjacent core elements, the fluid seal configured to form a fluid-tight boundary between the fluid flow path and the coolant flow path.

2. The heat exchanger of claim 1, further comprising a head having a fluid inlet port, a fluid outlet port, a coolant inlet port and a coolant outlet port, the head being connectable to the heat exchanger shell.

3. The heat exchanger of claim 1, further comprising an inlet plenum located between the heat exchanger shell and the heat exchanger core and an outlet plenum located between the heat exchanger shell and the heat exchanger core separate from the inlet plenum.

4. The heat exchanger of claim 1, wherein each core element includes a coolant inlet aperture and a coolant outlet aperture formed through the first and second opposing plates respectively.

5. The heat exchanger of claim 4, wherein the coolant flow path extends between the coolant inlet apertures and the coolant outlet apertures within the core.

6. The heat exchanger of claim 4, further comprising a fluid tight seal formed about the coolant inlet apertures and the coolant outlet apertures to prevent fluid communication between the fluid flow path and the coolant flow path.

7. The heat exchanger of claim 1, wherein the heat exchanger shell includes an inner wall formed with arcuate sections.

8. The heat exchanger of claim 7, wherein the heat exchanger core includes arcuate first and second sidewall portions substantially conforming with the arcuate sections of the inner wall of the heat exchanger shell.

9. The heat exchanger of claim 8, further comprising a peripheral seal engaged between the arcuate sidewall portions and the arcuate sections of the inner wall of the shell.

10. The heat exchanger of claim 1, wherein each of the opposing plates of each core element includes a corrugation with alternating peaks and troughs.

11. The heat exchanger of claim 10, wherein the peaks and troughs of the corrugation include an alternating angled V-shaped pattern formed across each plate of each core element.

12. The heat exchanger of claim 11, wherein the V-shaped pattern on the first plate of each core element is an opposite mirror image of the V-shaped pattern on the second plate of each core element across the plates.

13. The heat exchanger of claim 12, wherein the peaks of the corrugation on adjacent plates engage one another at intermittent locations.

* * * * *